US009499992B2

(12) United States Patent
Busby

(10) Patent No.: US 9,499,992 B2
(45) Date of Patent: Nov. 22, 2016

(54) PRECISION HEIGHT ADJUSTABLE FLOORING SUBSTRATE SUPPORT SYTEM

(71) Applicant: Philip Busby, Beaverton, OR (US)

(72) Inventor: Philip Busby, Beaverton, OR (US)

( * ) Notice: Subject to any disclaimer, the term of this patent is extended or adjusted under 35 U.S.C. 154(b) by 44 days.

(21) Appl. No.: 14/304,606

(22) Filed: Jun. 13, 2014

(65) Prior Publication Data

US 2014/0366461 A1 Dec. 18, 2014

Related U.S. Application Data

(60) Provisional application No. 61/834,989, filed on Jun. 14, 2013.

(51) Int. Cl.
*E04F 15/02* (2006.01)

(52) U.S. Cl.
CPC ... *E04F 15/02183* (2013.01); *E04F 15/02044* (2013.01); *E04F 2015/02127* (2013.01)

(58) Field of Classification Search
CPC ..... E04F 15/02044; E04F 15/02183; E04F 2015/02127
See application file for complete search history.

(56) References Cited

U.S. PATENT DOCUMENTS 3,025,934 A * 3/1962 Spiselman ..... E04F 15/02452 254/100
3,150,748 A * 9/1964 Liskey, Jr. ..... E04F 15/02405 52/126.6
3,616,584 A * 11/1971 Sartori ..... E04F 15/02452 248/354.3
4,656,795 A * 4/1987 Albrecht ..... E04F 15/02435 52/126.6
5,263,289 A * 11/1993 Boyd ..... E04F 15/024 52/220.2
5,333,423 A * 8/1994 Propst ..... E04F 15/02476 248/188
7,509,782 B2 * 3/2009 Colosimo ..... E04F 15/02435 52/126.6
8,490,234 B2 * 7/2013 Rowell ..... E04F 15/02447 14/2.4
8,677,703 B2 * 3/2014 Meyer ..... E04F 15/02405 52/126.6
8,898,999 B1 * 12/2014 Kugler ..... E04F 15/02464 52/126.6
2002/0026757 A1 * 3/2002 Scissom ..... E04F 15/02452 52/220.2
2003/0051420 A1 * 3/2003 Leon ..... E04F 15/024 52/126.6

* cited by examiner

*Primary Examiner* — Jeanette E Chapman
(74) *Attorney, Agent, or Firm* — Mark S Hubert

(57) ABSTRACT

A precision height and slope adjustable flooring substrate system for providing a truly planar array of fiber reinforced polymer structural panels so as to form a lightweight deck surface for the attachment of a surfacing material, such as a quarried stone, tile, concrete paver of the like to the top of the panel, providing a water proof stone deck surface that maintains the integrity of the underlying deck structure and can be precisely leveled without requiring substantial structural support. The system utilizes various interconnected plates, spacers, adapters and stanchions to achieve the correct height and slope compensation to achieve a truly horizontal, planar deck for the structural panel. With the use of specialized adapters on plate members, they can be attached above or below dimensional lumber to allow for the attachment to a framed open deck or to install a framed open deck above a planar deck.

8 Claims, 22 Drawing Sheets

PRECISION HEIGHT ADJUSTABLE FLOORING SUBSTRATE SUPPORT SYTEM

This application claims priority from U.S. Provisional Patent Application Ser. 61/834,989 filed Jun. 14, 2013 and entitled "Precision Height Adjustable Flooring Substrate Support System.

BACKGROUND OF THE INVENTION

This invention relates to outdoor flooring, surfaces for decks, rooftop terraces, patios and the like, and more particularly, to a decking system and method for enabling use of surface materials that would ordinarily lack suitable structural features to accommodate deck, rooftop terraces or patio applications.

Stone or stone-like walkways, terraces, patios and steps are frequently used at homes and businesses, as the appearance is attractive and enjoyed by many. Generally, these stones must be laid onto a level, on-grade, firm soil. Walkway and step stones are typically rather thick, to provide sufficient internal structural properties to support weight necessary in walkway and step use. In addition, thin-gauged stones used in this same manner, with no internal structural properties, require a thick concrete pad for support.

Many residential second floor decks are sloped for drainage or are above waterproofed lower decks or living spaces and as such cannot employ mechanical penetrations that would breech the integrity of the decks protective waterproofing. Common commercial roofs or decks have multiple slopes and numerous protrusions such as drains or vents and must have an elevated flooring substrate system above the waterproofing to attach and or support the stones in order to present an aesthetically attractive and structurally stable planar array of stone. For joist framed decks to be finished with the same stone or stone-like material would require a solid, water resistant structural support spanning between multiple joist framing. This is not possible without breaking the rooftop membrane or seal that keeps the water out and allows any drainage to run off.

Henceforth, an outdoor flooring, deck, rooftop terrace and patio surface system would fulfill a long felt need in the construction industry. This new invention utilizes and combines known and new technologies in a unique and novel configuration to overcome the aforementioned problems and accomplish this.

SUMMARY OF THE INVENTION

In accordance with the invention, a deck, rooftop terrace and patio surface system comprises a base mounting plate to which may be attached a post for mechanical attachment to a fiber reinforced structural panel employed as a substrate underlayment, may be attached to either of two mounting fasteners for attaching a paver stone or may be attached to a set of framing braces for connecting dimensional lumber to a deck, or to deck framing, or onto a stanchion assembly. Additionally, adjusting the height and tilt of the mounting fasteners can be accomplished by a wedge plate, a stacker plate, a leveler plate assembly, wide base assembly and a wedge plate. Lastly, large height requirements may be accommodated by an array of stanchion assemblies that can be stabilized with support rods connected horizontally or diagonally between stanchion assemblies. Accordingly, it is an object of the present invention to provide an improved deck system to enable use of stone or stone-like surfaces, of varying non-uniform shapes and sizes, of varying thicknesses, in above-ground framed deck and rooftop terrace applications.

It is a further object of the present invention to provide an improved system for the use of stone in deck, rooftop or patio applications where the deck, rooftop or patio alone would not allow for the aesthetic use of stones.

It is yet another object of the present invention to provide an improved method for providing a truly planar deck surface utilizing connectors that reside below the plane of affixation for the surface adornment stone.

Another objective of the present invention is to provide a deck, rooftop terrace or patio system with full drainage on the top surface by allowing water to pass directly past the stones and the panels/mounting fasteners.

Another object of the present invention is to provide a deck or patio system adapted for use over a sloped waterproofed living space without requiring penetration of the waterproof membrane. The deck or patio system shall allow water to pass directly past the stones and the panels.

Another object of the present invention is to provide a system of deck or patio panels adapted for easy subdivision into panels sized adapted for use with conventionally sized commercially available stones or to adapt to standard building dimensions.

It is still another object of the present invention to provide a system and method for providing a new floating or raised surface over an open framed or waterproofed rooftop terrace and to provide a support system that creates an interlocking flooring system adjoining all flooring panels as one floor.

It is still a further object of the preset invention to create a support system that enables the interlock of traditional rooftop pavers into an interconnected flooring rather than individual floating pavers as in current technology and to provide a support system that creates a mechanically fastened assembly for flooring to stanchion for high wind (HW) stability.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

It has many of the advantages mentioned heretofore and many novel features that result in a new outdoor flooring, deck, rooftop terrace and patio surface system which is not anticipated, rendered obvious, suggested, or even implied by any of the prior art, either alone or in any combination thereof.

DETAILED DESCRIPTION

Figure 1:
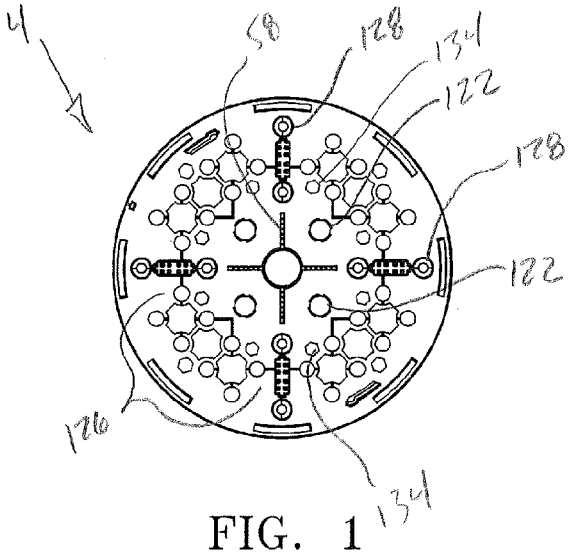
FIGS. 1-5 are top, top perspective, side, 90 degree rotated side and bottom views of the mounting base plate.
Figure 2:
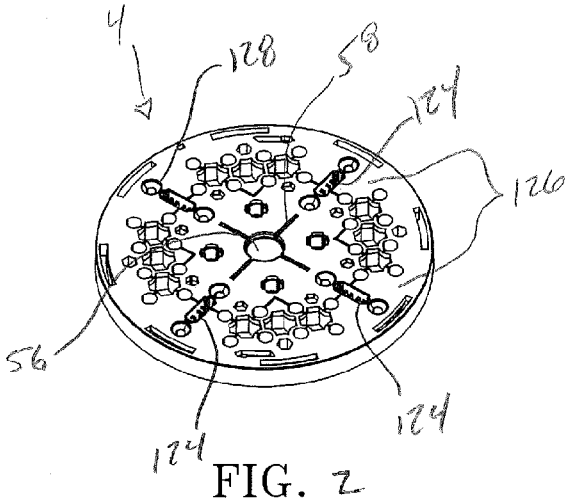
Figure 3:
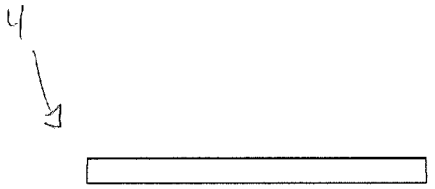
Figure 4:
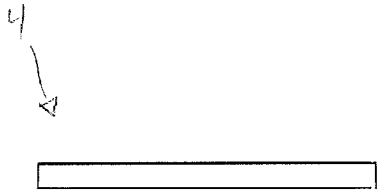
Figure 5:
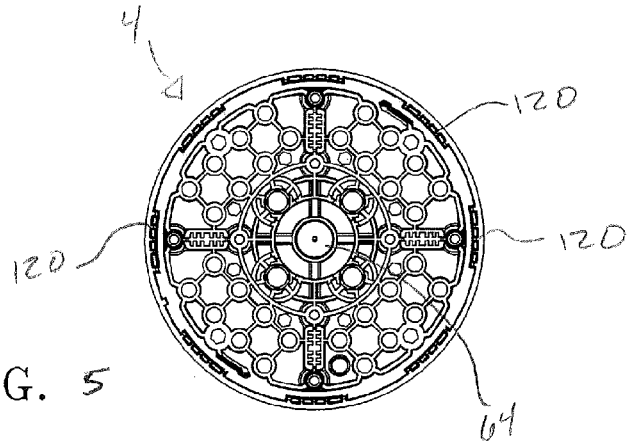
Figure 6:
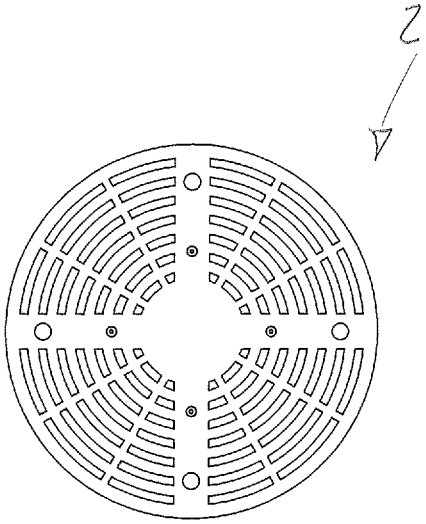
FIGS. 6-9 are the top, top perspective, side and 90 degree rotated side a views of the anchor plate.
Figure 7:
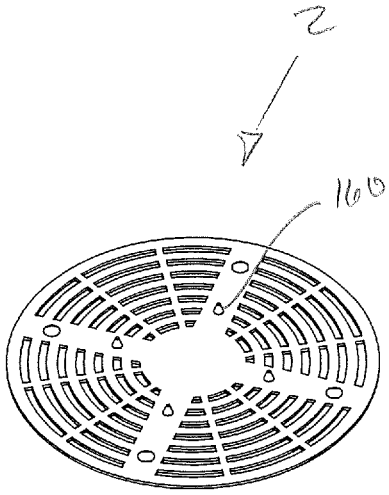
Figure 8:
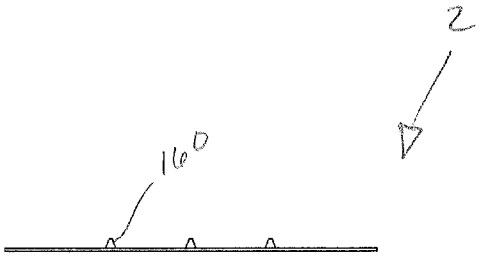
Figure 9:
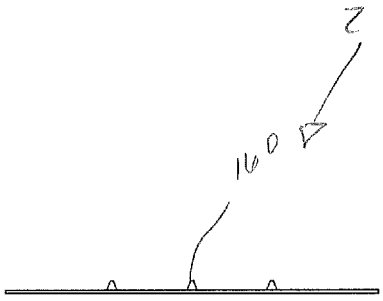
Figure 10:
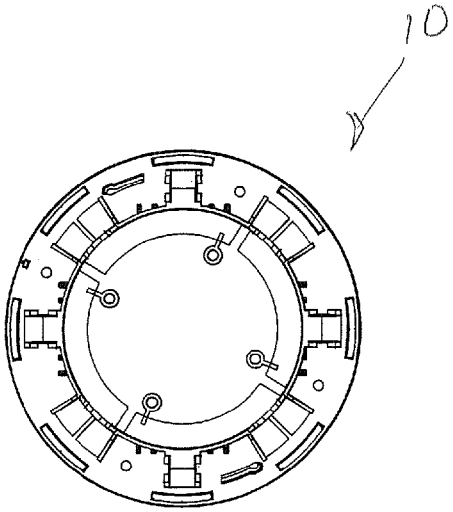
FIGS. 10-14 are top, top perspective, side, 90 degree rotated side and bottom views of the stanchion bottom plate.
Figure 11:
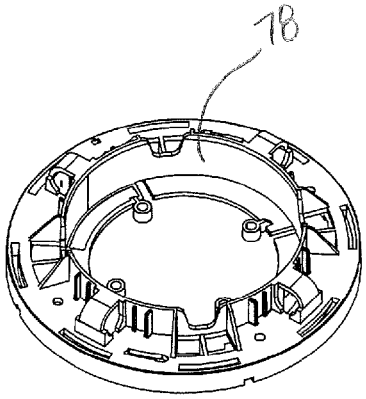
Figure 12:
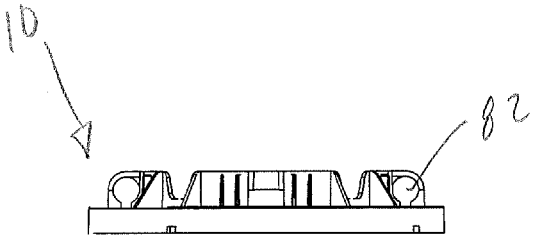
Figure 13:
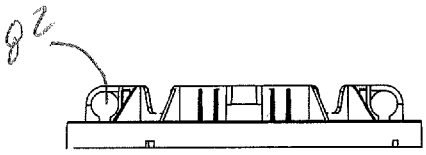
Figure 14:
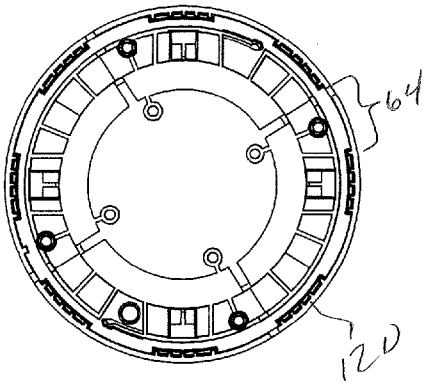
Figure 15:
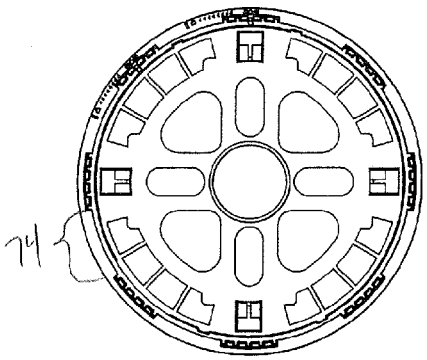
FIGS. 15-19 are top, top perspective, side, 90 degree rotated side and bottom views of the stanchion top plate.
Figure 16:
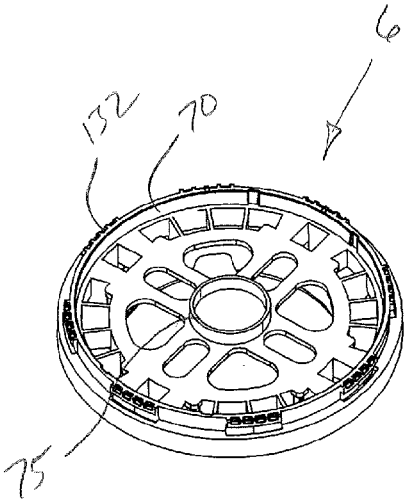
Figure 17:
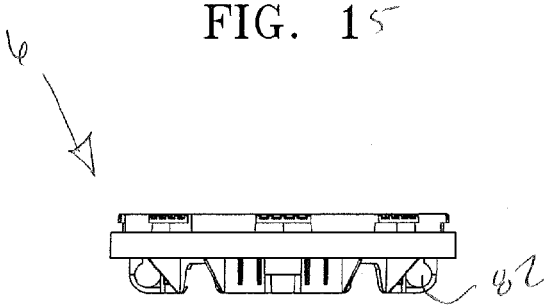
Figure 18:
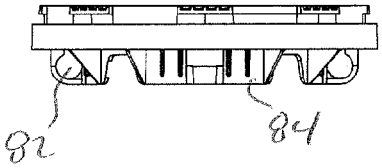
Figure 19:
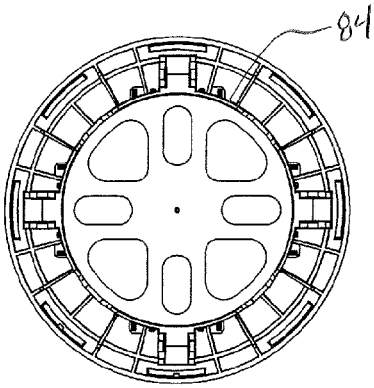
Figure 20:
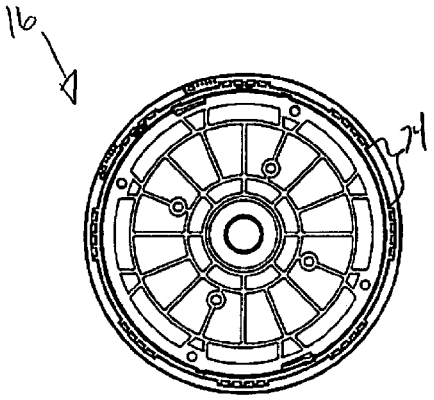
FIGS. 20-24 are top, top perspective, side, 90 degree rotated side and bottom views of the stacker plate.
Figure 21:
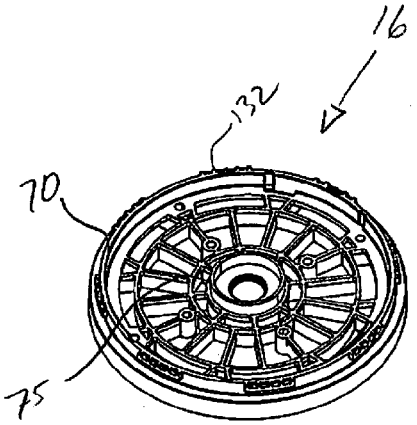
Figure 22:
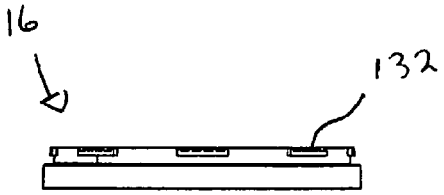
Figure 23:
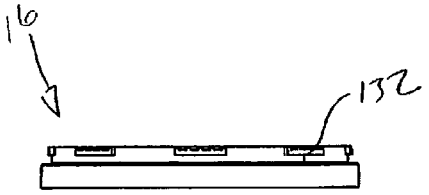
Figure 24:
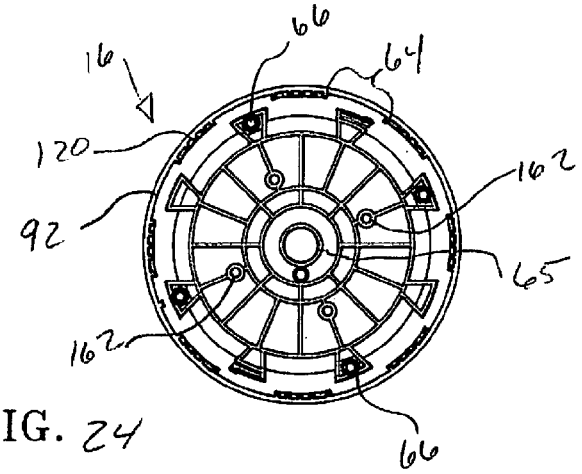
Figure 25:
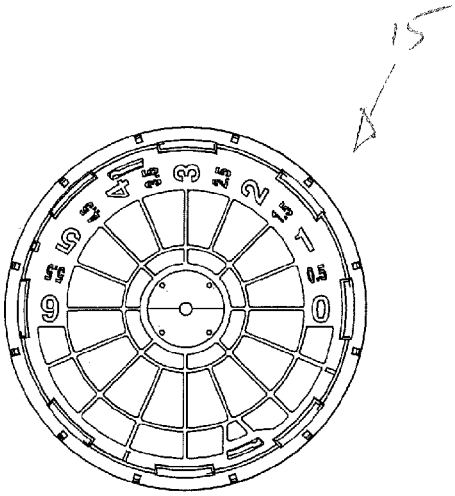
FIGS. 25-29 are top, top perspective, side, 90 degree rotated side and bottom views of the bottom leveler plate.
Figure 26:
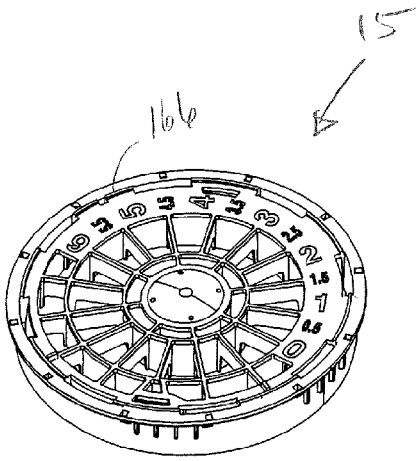
Figure 27:
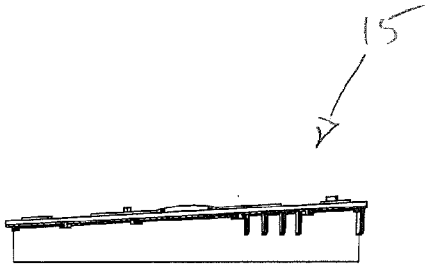
Figure 28:
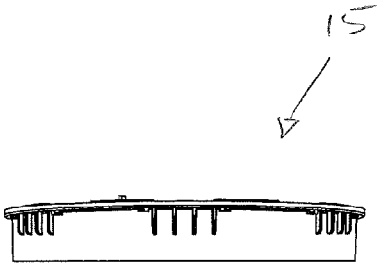
Figure 29:
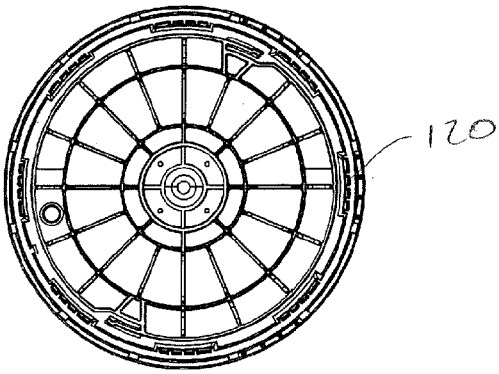
Figure 30:
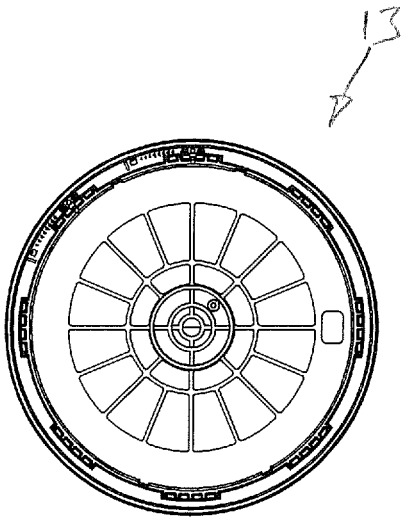
FIGS. 30-34 are top, top perspective, side, 90 degree rotated side and bottom views of the leveler top plate.
Figure 31:
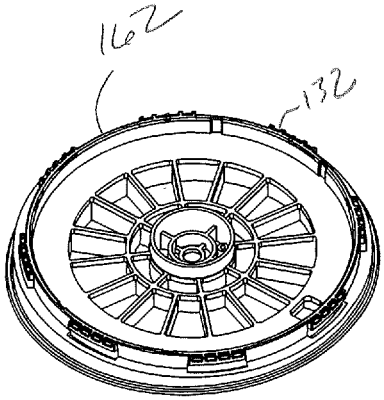
Figure 32:
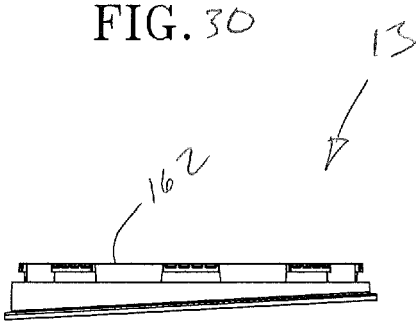
Figure 33:
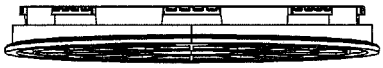
Figure 34:
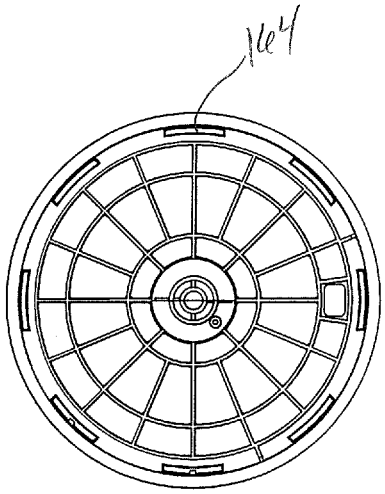
Figure 35:
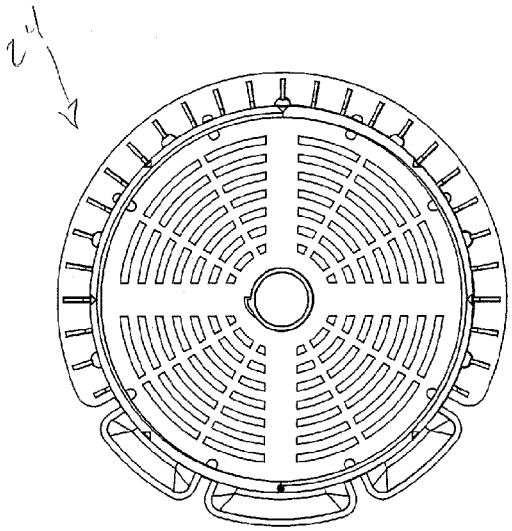
FIGS. 35-39 are top, top perspective, side, 90 degree rotated side and bottom views of the wide base plate.
Figure 36:
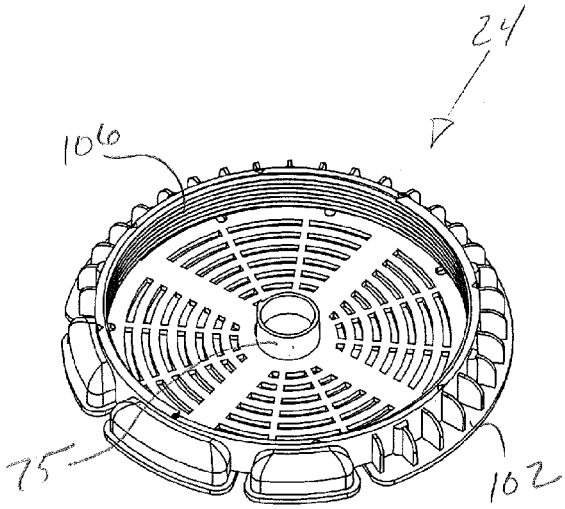
Figure 37:
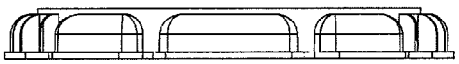
Figure 38:
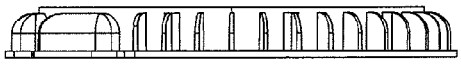
Figure 39:
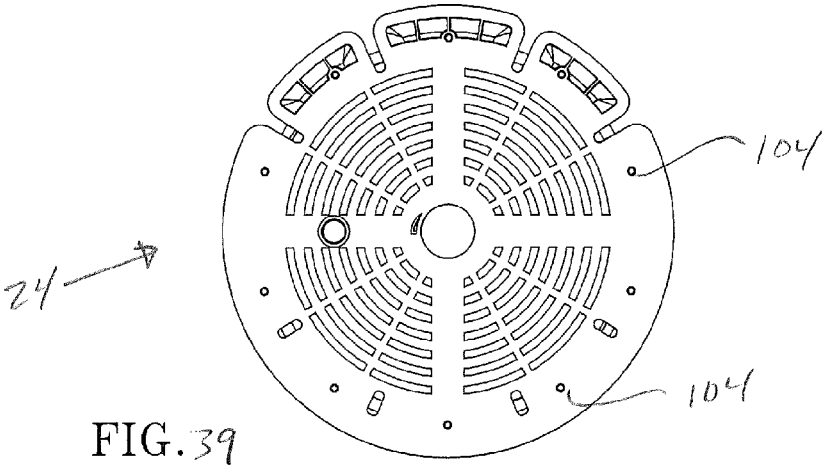
Figure 40:
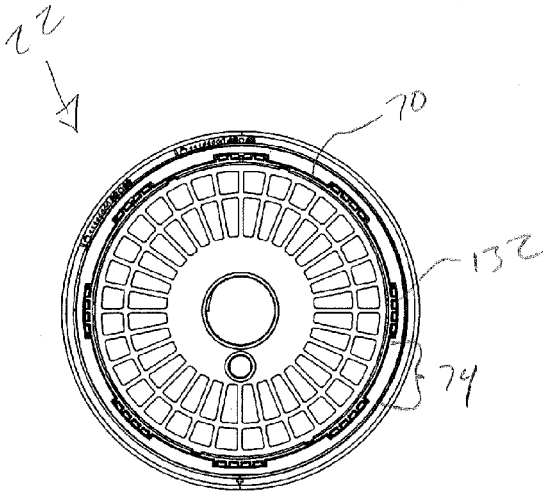
FIGS. 40-44, are top, top perspective, side, 90 degree rotated side and bottom views of the micro adjust plate 40.
Figure 41:
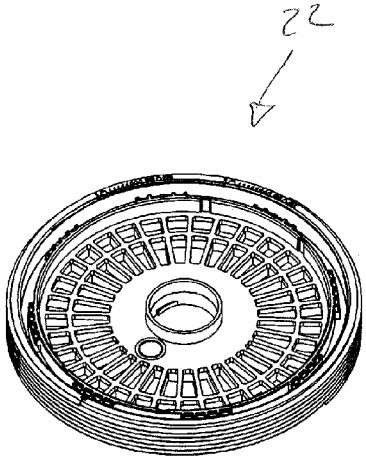
Figure 42:
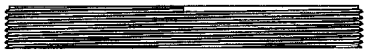
Figure 43:
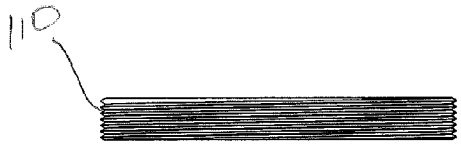
Figure 44:
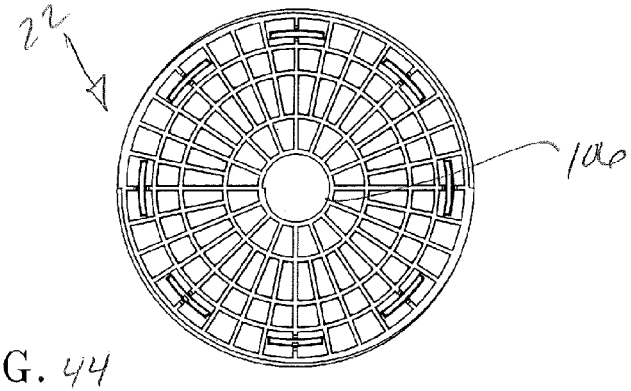
Figure 45:
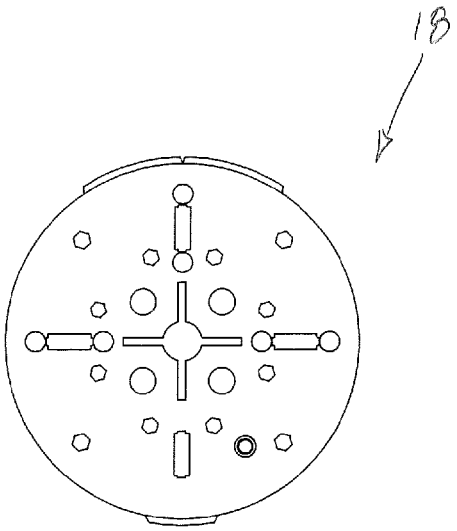
FIGS. 45-48 are top, top perspective side, and 90 degree rotated side views of the ½ degree wedge plate.
Figure 46:
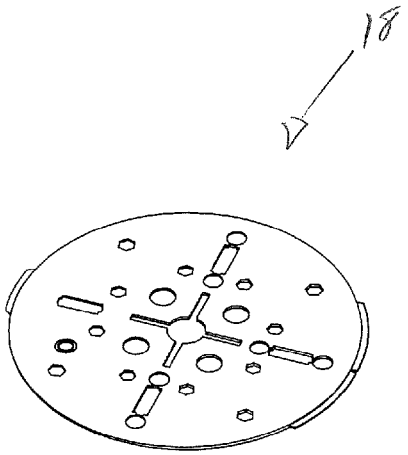
Figure 47:
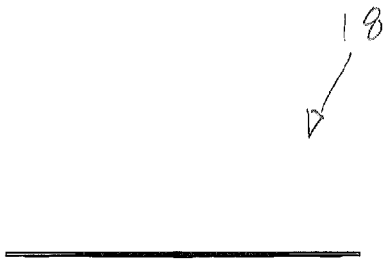
Figure 48:
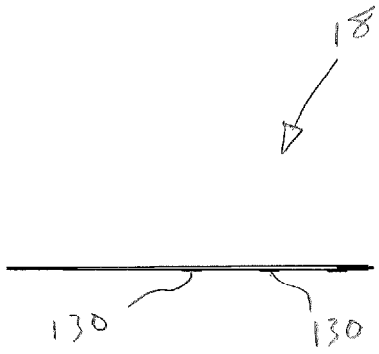
Figure 49:
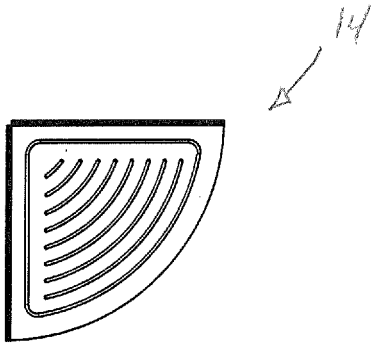
FIGS. 49-52 are top, top perspective, side and 90 degree rotated side views of the paver plates.
Figure 50:
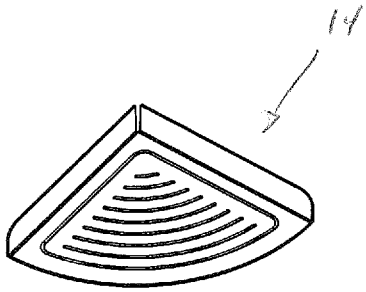
Figure 51:
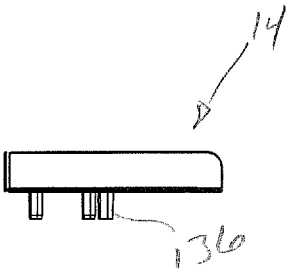
Figure 52:
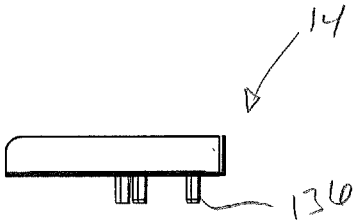
Figure 53:
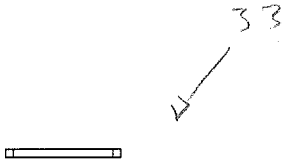
FIG. 53-56 are top, perspective, side and 90 degree rotated side views of a first thickness brick post.
Figure 54:
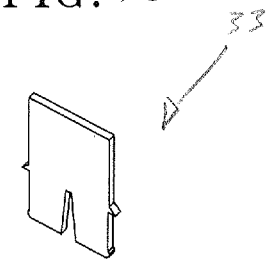
Figure 55:
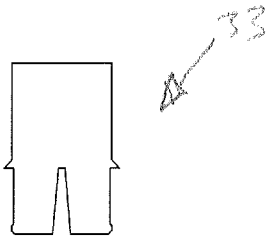
Figure 56:
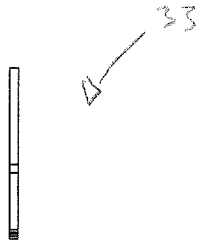
Figure 61:
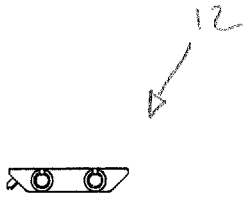
FIGS. 61-64 are top, perspective, side and 90 degree rotated side of the framing members.
Figure 62:
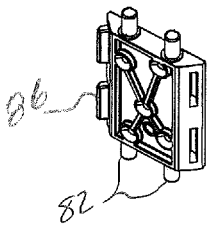
Figure 63:
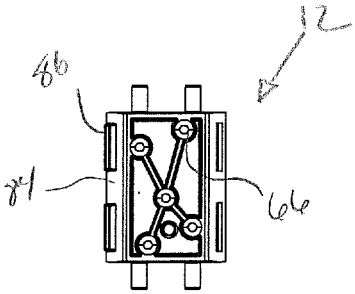
Figure 64:
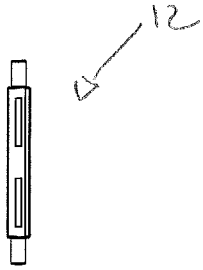
Figure 57:
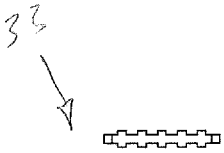
FIGS. 57-60 are top, perspective, side and 90 degree rotated side views of a second thickness brick post.
Figure 58:
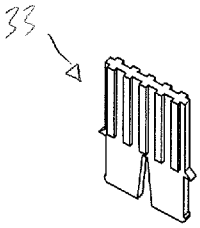
Figure 59:
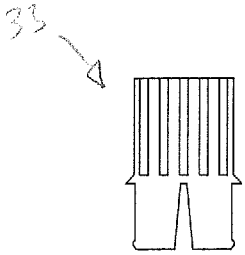
Figure 60:
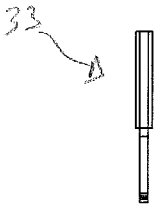
Figure 65:
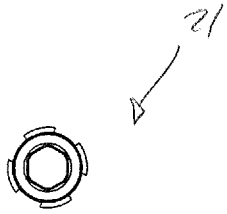
FIGS. 65-68 are top, perspective, side and 90 degree rotated side views of the post.
Figure 66:
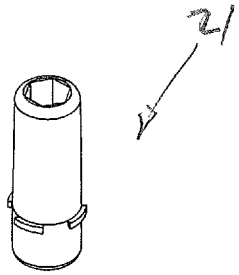
Figure 67:
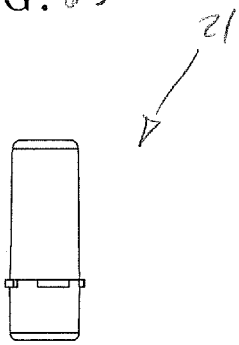
Figure 68:
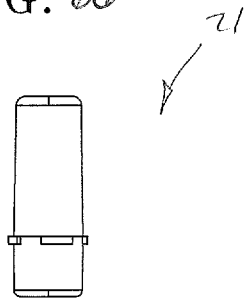
Figure 69:
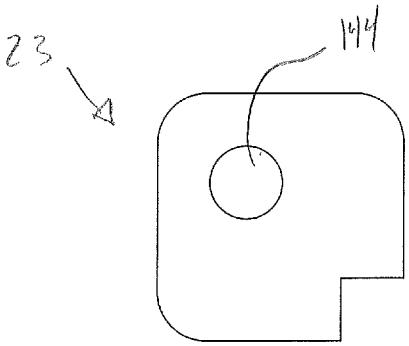
FIGS. 69-72 are top, perspective, side and 90 degree rotated side views of the panel puck.
Figure 70:
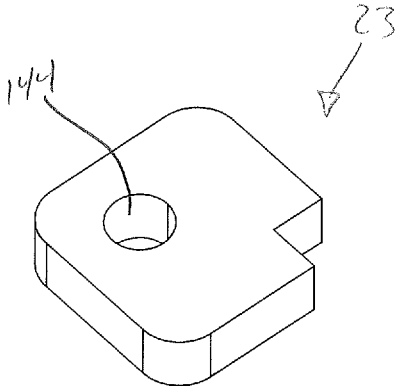
Figure 71:
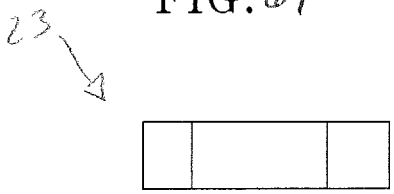
Figure 72:
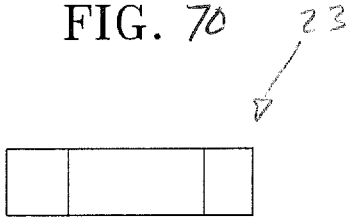
Figure 73:
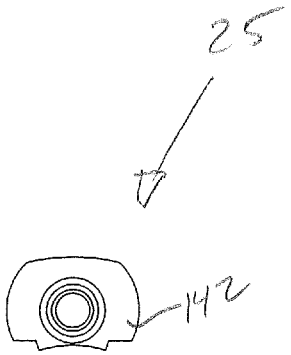
FIGS. 73-76 are top, perspective, side and 90 degree rotated side views of the threaded post.
Figure 74:
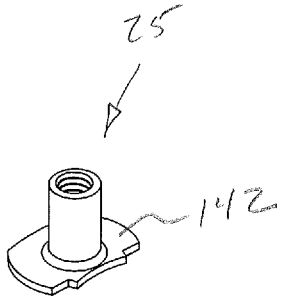
Figure 75:
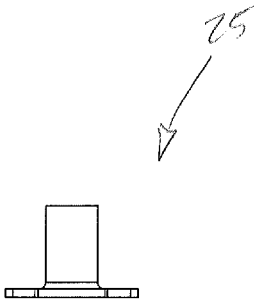
Figure 76:
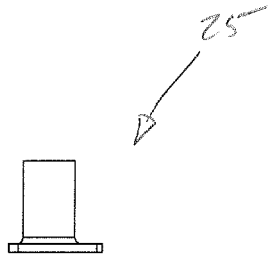

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

The term "deck" as used herein, refers to a decking structure having a planar substrate base like a roof (sloped or otherwise) whether it has a contiguously planar surface or is an open, structure made of framing members such as dimensional lumber.

The term "finished flooring element" as used herein, refers to the top flooring element such a stone, pavers, tile and the like.

Basically, the present invention is a synergistic system of interconnecting, structural panels, height adjustable polymer, generally planar, base plates, spacers, angle adapters, stanchion assemblies and mounting plates that form a support system for the attachment of a top layer of dimensional lumber, paver tile supports or open cell polymer panels onto above-ground framed deck and rooftop terrace applications. On this support system the finish surface of tiles, pavers or decking affixed.

The open structure allows moisture to drain through the system. There is no need for grout to be employed between the pavers or tiles. This system may be installed in an adjustable, raised position above the deck to compensate for any non horizontal or non planar anomalies in the area, such as may be found on the rooftop of a commercial building. Further, the system (raised or not) may be mechanically affixed to the area or may be installed as a floating flooring substrate, wherein the mass and friction of the entire sub floor assembly with the flooring installed maintains its horizontal position. The floating option is used where it is not desirable to have any penetrations into the underlying area, such as is the case when it forms the ceiling of another living space. Generally, in such applications, a waterproof membrane such as a 40 mil bituminous based material, is placed over the deck to protect the framing from water damage over time.

The system allows for at least three types of surface finishes or a structural member framed deck, to be situated above a planar deck, sloped or otherwise. First, it can install finished stone, concrete pavers or tile using a structural panel 30 (affixed to a base mounting plate 4). Second, it can install concrete pavers (directly affixed to a base mounting plate 4 with brick post 33). Third, it can install finished stone, tile, or concrete pavers (affixed to a triangular paver plate 14 affixed to base mounting plate 4). Lastly, the system can allow for the placement of a structural member framed deck, on top of a planar deck (affixed by framing braces 12 inserted into the top face of the mounting base plate 4.)

It can also accommodate the previously discussed three types of surface finishes on top of non planar, decking frames made of wooden structural members such as 2×4's, 2×6's, etc. This is accomplished by positioning the mounting base plate 4 atop of the structural members (affixed by framing braces 12 inserted into the bottom face of the mounting base plate 4).

To accommodate the raised positioning of the system, several combinations of system elements may be utilized as set forth below. These involve an anchor plate 2, base mounting plate 4, stanchion assembly 7, leveler plate assembly 11, wedge plate 18, stacker plate 16, wide base assembly 20, framing braces 12, support guide 26, support rod 28, paver plate 14, brick post 33, panel puck 23, retaining clip 32, post 21, and threaded post 25. The system also has provisions for high wind (HW) applications.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

The following table will illustrate all the various components of the system, their purpose and what they can connect to below and what can connect to them from above.

TABLE A

COMPONENT CONNECTIVITY OF THE FLOORING SUBSTRATE SUPPORT SYSTEM

| # | Component Name | Function | Connects Above | Connects Below |
|---|---|---|---|---|
| 2 | Anchor Plate | Screws to deck planar surface for attachment to stanchion bottom, or spacer plate | deck | Stanchion Bottom or Spacer Plate |
| 4 | Base Mounting Plate (for pavers, lumber and frames) | final plate for the attachment of Paver Plates, brick posts, Structural Panels or Framing Braces (Structural lumber; | Stacker Plate, Top Stanchion Plate, Top Leveler Plate, or structural lumber w Framing Braces | Wedge Plate, or structural lumber w Framing Braces, Brick Posts, Structural Panel, Paver Plate |
| 7 | Stanchion Assembly (made of top, stanchion and bottom) | Raises height of the Base Mounting Plate | Micro Adjust Plate, Stacker Plate, Leveler Top Plate or deck surface | Base Mounting Plate, Stacker Plate, or Leveler Bottom Plate |
| 6 | Stanchion Top Plate | Mounts to base mounting plate, spacer plate, leveler bottom plate | Stanchion | Base Mounting Plate, Stacker Plates, or Bottom Leveler Plate |
| 8 | Stanchion Post | Raise Height of either of the Mounting Plates | Stanchion Bottom | Stanchion Top |
| 10 | Stanchion Bottom Plate | Mounts to Micro Adjust Plate, Anchor Plate, or deck surface | Micro Adjust Plate, Stacker Plate, Anchor Plate, Leveler Top Plate | Stanchion |
| 11 | Leveler Plate Assembly (made of Leveler top and leveler bottom) | Adjusts the angle of Base Mounting Plate or the Stanchion Assembly in one or two planes | Micro Adjust Plate, Stacker Plate, Stanchion Top Plate | Base Mounting Plate |
| 13 | Leveler Top Plate | | Leveler Bottom | Base Mounting Plate |
| 15 | Leveler Bottom Plate | | Micro Adjust Plate, Stacker Plate, Stanchion Top Plate | Leveler Top |
| 12 | Framing Braces | Allows for the connection to dimensional lumber | Base Mounting Plate | Base Mounting Plate |
| 14 | Paver Plate | Allows the paver stone corners to be supported | Base Mounting Plate or ½° Wedge Plates | nothing |
| 16 | Stacker Plates | Raises height in ½" increments | Deck Membrane, ½° Wedge Plates | Paver and Frame Mounting Plate, and Panel Mounting Plate |
| 18 | /° Wedge Plate | Adjusts height by a 1° difference between sides | Top of Base Mounting Plate | Structural Panel, Paver Plate, Brick Post or Threaded Post |
| 20 | Wide Base Assembly (made of micro adjust plate 22 and wide base 24) | Adjustably Supports Base Mounting Plate, Stacker Plates, Leveler Plates and Stanchion Bottom Plate | Deck Membrane | Base Mounting Plate, Stacker Plates, Leveler Plates and Stanchion Bottom Plate |
| 22 | Micro Adjust Plate | Variably adjusts the height of the Stanchion | Wide Base | Base Mounting Plate, Stacker Plates, Leveler |

TABLE A-continued

COMPONENT CONNECTIVITY OF THE FLOORING SUBSTRATE SUPPORT SYSTEM

| # | Component Name | Function | Connects Above | Connects Below |
|---|---|---|---|---|
| | | Assembly | | Plates and Stanchion Bottom Plate |
| 24 | Wide Base | Supports Stanchion Assembly | Deck Membrane | Micro Adjust Plate |
| 26 | Support Guide | Holds ends of Support Rod | nothing | nothing |
| 28 | Support Rod | Connects adjacent stanchions | nothing | nothing |
| 30 | Structural Panel | Provide surface to attach thin and small tiles | Base Mounting Plate | Thin, small tiles |
| 32 | Retaining Clip | Attach structural panel to Threaded Post in Panel Puck in Base Mounting Plate | Structural Panel | Thin small tiles |
| 34 | Bolt | Attach Retaining Clip to Threaded Post in Panel Mounting Plate | Thin, small tiles | Retaining Clip |
| 21 | Post | Provides post to allow connecting into panel puck on panel | Base Mounting Plate | Panel |
| 23 | Panel Puck | Provides moveable point on panel for securing to base mounting plate | Base Mounting Plate | Panel |
| 25 | Threaded Post | Provides post to allow connection into panel puck on panel | Base Mounting Plate | Panel |
| 33 | Brick Post | Mounts to the Base Mounting Plate to secure brick sides | Base Mounting Plate | Brick |

Table A indicates the connectivity of the various components. As can be seen a plethora of arrangements is available to suit the various heights, angles and conditions of that specific installation.

Base Mounting Plate

Figure 82:
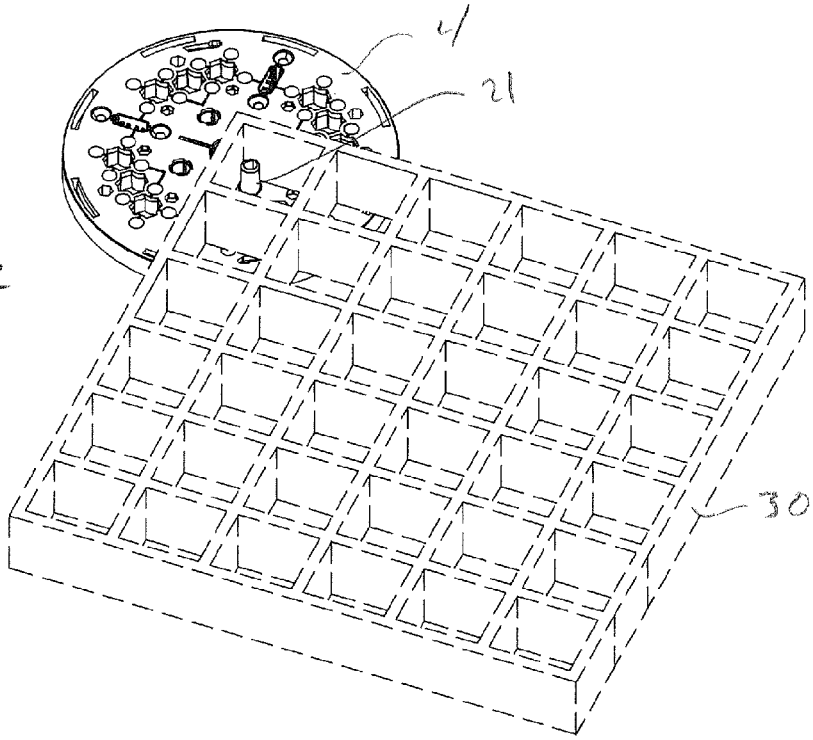
FIG. 82 is perspective top view of a structural panel mounted on a base mounting plate with a post.
Figure 83:
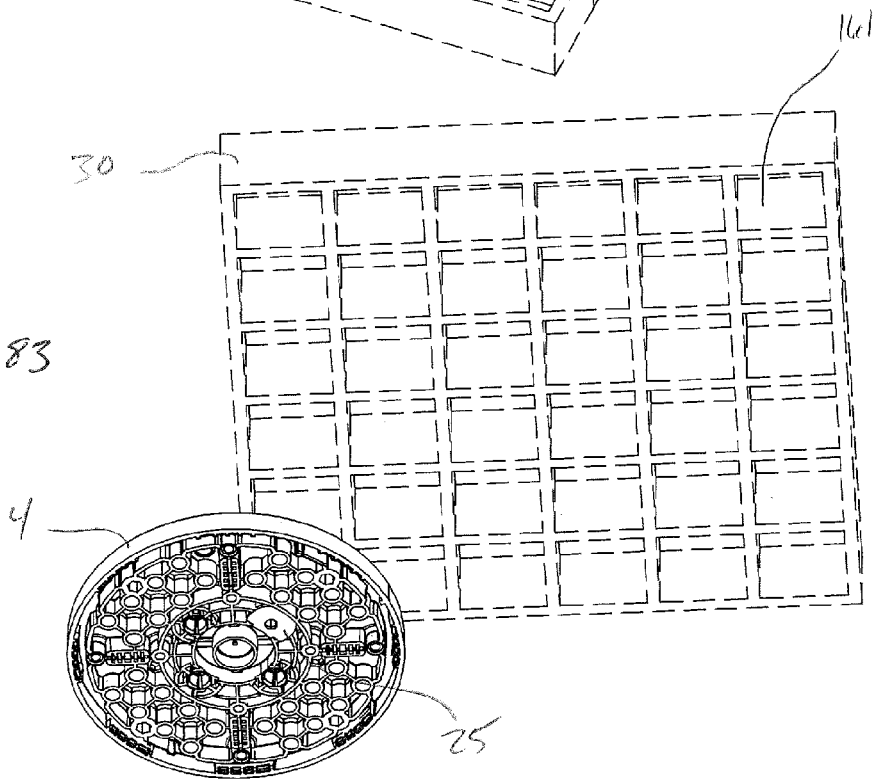
FIG. 83 is a perspective bottom view of a structural panel mounted on a base mounting plate with a threaded post.
Figure 84:
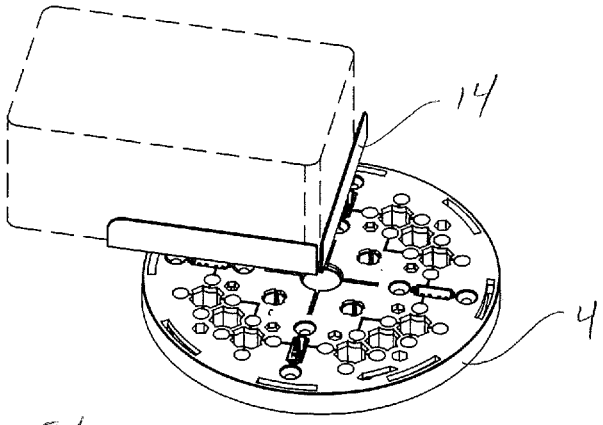
FIG. 84 is a perspective top view of a paver mounted on a paver plate atop of a base mounting plate.
Figure 86:
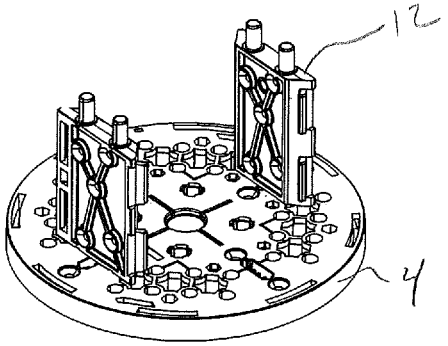
FIG. 86 is a perspective top view of a base mounting plate with framing braces affixed to the top surface thereof.
Figure 87:
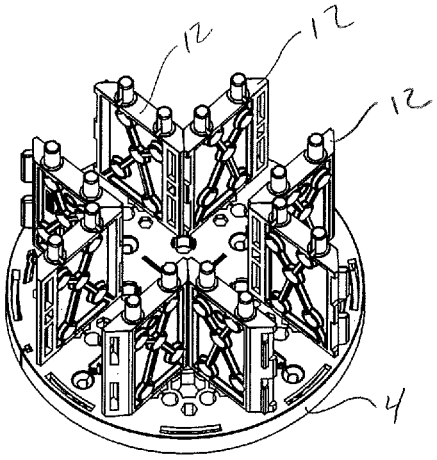
FIG. 87 is a perspective top view of a base mounting plate with framing braces aligned for structural cross bracing affixed to the top surface thereof.
Figure 88:
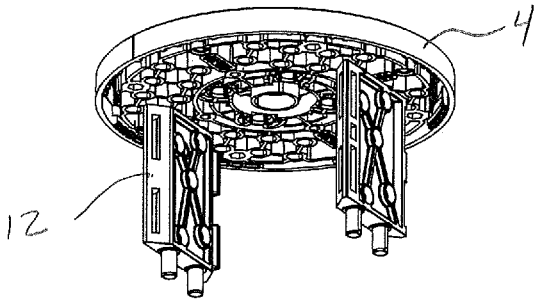
FIG. 88 is a perspective bottom view of a base mounting plate with framing braces affixed to the bottom surface thereof.
Figure 89:
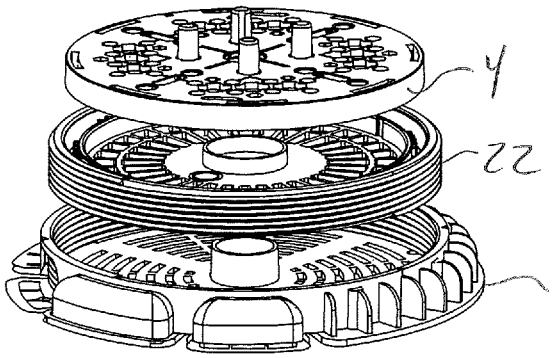
FIG. 89 is a perspective view of a base mounting plate stacked atop a micro adjust plate on a wide base plate.

The base mounting plate 4 is the key element or interface between the underlying supporting surface, any intervening combination of leveling or height changing elements and the structural panel, the stone, pavers, tile or wooden structural members. There is only one top member of any stacked array of the precision height adjustable flooring substrate support system. This is the base mounting plate 4. (FIGS. 1-5) This serves to support the structural panels 30 (as seen in FIGS. 82 and 83) or paver plates 14 (with or without the wedge plate 18 as seen in FIGS. 84 and 85), and the framing braces 12 (as seen in FIGS. 86 to 88.)

For connection of the base mounting plate 4 to the systems leveling and height adjustment components (as seen in FIGS. 89 to 93), the bottom face of the base mounting plate 4 has a series of internally facing twist lock engagement teeth ("IFT") 120. These IFT's engage with a series of externally facing twist lock engagement teeth ("EFT") 132 located on external flanges on other component plates such as found on the top face of the stacker plate 16. (FIGS. 20-24) It is through the engagement of the series of IFT with the series of EFT that the various plates are able to connect. In this way the "plunge and twist" style of interlocking frictional engagement between members (as is well know in the art) can be utilized to couple members to attain the desired height. There is also a central stabilization groove 64 formed thereon to accept the central ring flanges of other components.

For connection of the base mounting plate 4 to a structural panel 30, the base mounting plate 4 has a first set of orifices 122 for mating engagement and twist locking of post 21 or mating engagement of threaded post 25 (used for high wind situations.)

Figure 85:
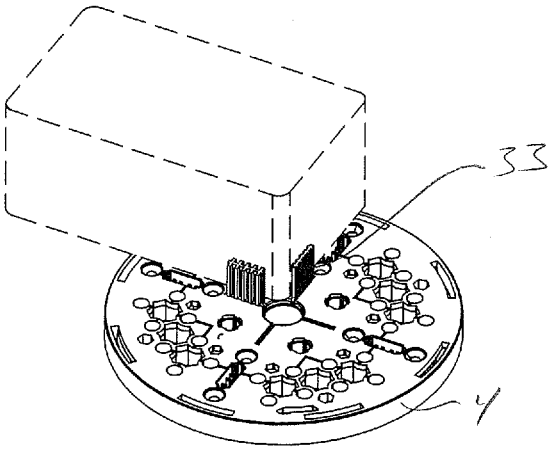
FIG. 85 is a perspective top view of a paver mounted directly atop a base mounting plate spaced by brick posts.

To allow the securement of bricks to the base mounting plate 4, (as seen in FIG. 85) the base mounting plate 4 has a set of four slots 124 for engagement with brick posts 33 which will extend above the top face of the base mounting plate 4 to align the sides of pavers placed thereon.

To allow the base mounting plate 4 to be attached to wooden structural members the base mounting plate 4 (as seen in FIGS. 86 to 88) also has sets of grouped orifices 126 for the engagement of the pins that extend normally from the framing braces 12. These groupings allow for the connection of multiple framing braces and at various angles to accommodate different structural lumber arrangements. Since these sets of grouped orifices 126 are through orifices, the posts at either end of the framing braces 12 can be placed on the top or bottom face of the base mounting plate 4.

To allow the base mounting plate 4 to be mechanically attached to a planar deck below without any leveling or height adjusting components, there is a second set of orifices 128 having tapered screw heads on the top face of the base mounting plate 4 to accommodate screws. These tapered screw heads are also capable of receiving the locating posts 130 on the bottom face of the wedge plate 18. (FIG. 45-48)

The top face of the base mounting plate 4, also has a central depression 56 for the insertion of a bubble level and a series of four card slots 58 spaced 90 degrees apart to hold a transit level readout card.

To allow the base mounting plate 4 to secure a triangular paver plate 14 so pavers may be installed, (as seen in FIG. 84) there is lastly, a third set of hexagonal orifices 134 that matingly engage the hexagonal pins 136 on the bottom face of the paver plate 14. (FIGS. 49-52)

Base Mounting Plate Leveling and Height Adjustment Configurations

FIGS. 89 to 93 show common connections between the base mounting plate 4 and other system leveling and height adjusting components. In the simplest variation FIG. 89, the base mounting plate 4 is stacked atop of an anchor plate 24 that has been glued or screwed to a planar, level deck surface. The conical protrusions on the anchor plate 24 engage into the bottom face of the base mounting plate 4 so as to prevent lateral motion.

Figure 91:
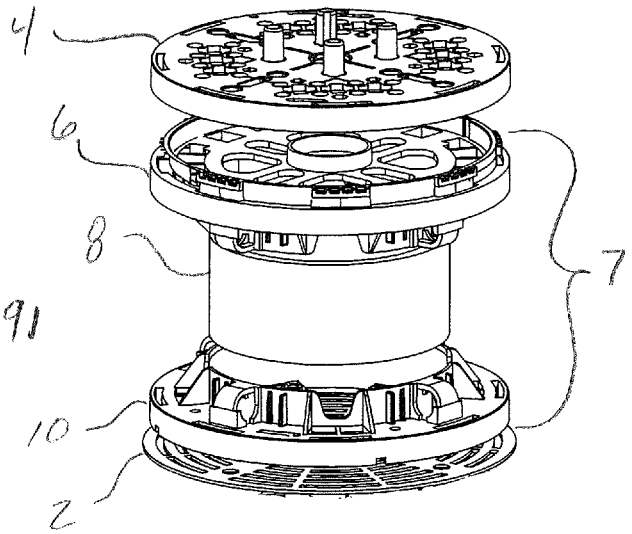
FIG. 91 is a perspective view of a base mounting plate stacked atop a stanchion top plate atop a stanchion post atop a stanchion bottom plate atop of an anchor plate.

The base mounting plate 4 may also be used atop of the height adjusting stanchion assembly 7, the stacker plates 16, the wedge plate 18 the wide base assembly 20, or any combination thereof. FIG. 91 shows an assembled stanchion assembly 7 with a base mounting plate 4 on the top and anchor plate 2 on the bottom. The stanchion assembly 7 is made up of a stanchion post 8 (polymer pipe) having a stanchion top plate 6 frictionally affixed about one end, and a stanchion bottom plate 10 frictionally affixed about the other end. In the preferred embodiment the stanchion post is a Schedule 40 four inch nominal pipe made of ABS, PVC of CVCP that is commercially available, and field cut to height. The tolerance for precision in the tilt angle and the height is quite generous as these can be adjusted or compensated for through combinations with the wide base assembly 20, the stacker plates 16 and the leveler plate assembly 11. (additionally with the wedge plate 18 but only atop of the base mounting plate 4.)

Figure 92:
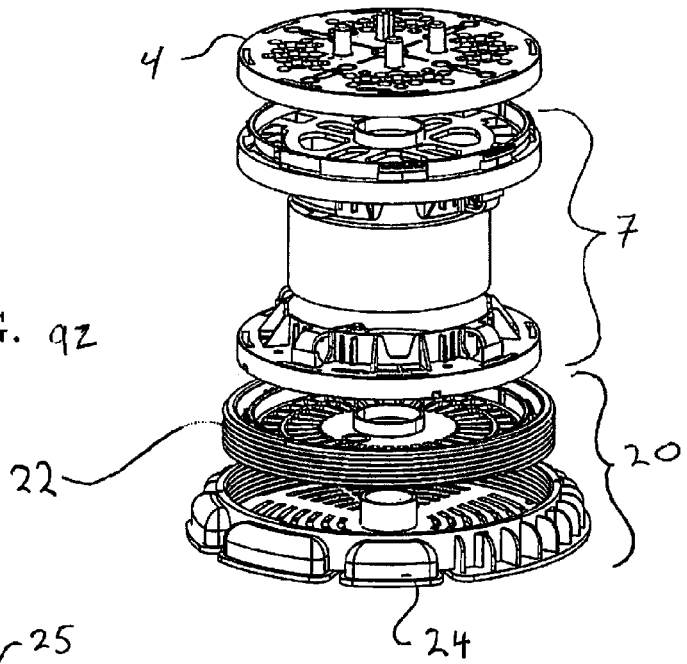
FIG. 92 is a perspective view of a base mounting plate stacked atop a stanchion atop a stanchion post atop a stanchion bottom plate atop of a micro adjust plate on a wide base plate.

FIG. 92 similarly illustrates the same configuration as FIG. 91 (an assembled stanchion assembly 7 with a base mounting plate 4 on top) but with the anchor plate 2 on the bottom removed and replaced by the wide base plate 24 and the micro adjust plate 22.

Figure 90:
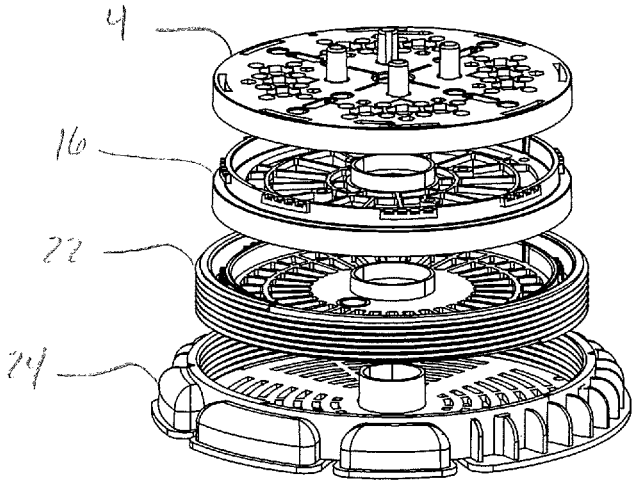
FIG. 90 is a perspective view of a base mounting plate stacked atop a stacker plate atop a micro adjust plate on a wide base plate.
Figure 93:
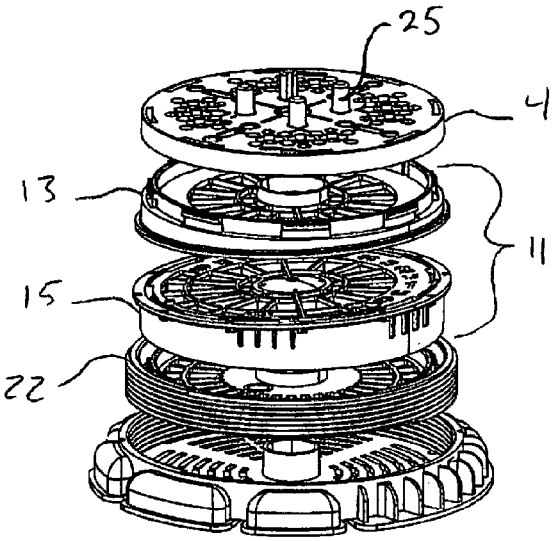
FIG. 93 is a perspective view of a base mounting plate atop of a leveler top plate atop a leveler bottom plate atop a micro adjust plate atop a wide base plate.

FIGS. 90 and 93 illustrate a base mounting plate 4 atop of two different combinations of leveling and height adjusting components without the need for extreme height adjustment using the stanchion assemblies of FIGS. 91 and 92.

FIG. 91 shows the base mounting plate stacked atop a stacker plate atop a micro adjust plate that rests on a wide base plate.

FIG. 93 uses a two part leveler plate assembly 11. This assembly alters the angle in either none, one or two axes simultaneously and is used to compensate for field conditions. Leveler top plate 13 (FIGS. 30-34) has a wedge configuration and has a raised peripheral flange 162 on its top face that has EFT 132 thereon. In this way it can engage with other components of the system that have IFT 120. Its bottom face has a series of interlocking slots 164 that engage in a series of interlocking tabs 166 on the top face of the leveler bottom plate 15. The bottom face of the leveler bottom plate has a series of IFT 120 for engagement on such components as the top of the stacker plate 16. The leveler bottom plate 15 also has a taper across its body.

Base Mounting Plate Used for with Tile

For the installation of tile, (optionally stone, concrete pavers or the like) an open celled structural panel 30 is used. (FIGS. 82 and 83) The structural panel 30 serves as a planar substrate for the mounting of the finished flooring. The bonding of the finished tile, stone, concrete pavers or the like, to the open celled structural plastic panel is accomplished using a flexible adhesive without any cement based bonding or bedding materials.

The structural panel 30 suitably comprises a fiber reinforced polymer panel having a grid pattern of openings (open cells) 161 in the illustrated embodiment of FIGS. 82 and 83, it is adapted to be received on top of the base mounting plate 4. On each of the four sides of each cell is a linear detent. In use, the structural panel 30 has its corner section located atop of the base mounting plate 4 adjacent three other corners of other structural panels 30 that are affixed to the base mounting plate 4 as discussed herein. Any height and any unevenness or slope of the underlying deck is compensated for by the section of the proper combination of the other system components.

The structural panel is mounted either directly atop a level planar deck or atop the base mounting plate 4 (see FIGS. 82 and 83.) The base mounting plate 4 must be used in the majority of situations where leveling and height adjustment is necessary. The structural panel 30 can be affixed to the base mounting plate 4 in two different ways.

The open cells of the structural floor panel taper inward from their top to bottom at approximately 2 degrees, with a minus 1 degree and plus 10 degree tolerance to enable the release of the structural panels from their mold. The array of open cells in the structural panel is spaced and divided into standard 16" and 24" O.C. dimensions accommodating the cut down of a 48"×48" panel to 16"×48" or 24"×48" panels with a full perimeter bar structure so as to meet USA dimensional building standards and accommodate commercially available flooring products. Such an open celled structural floor panel 30 has been fully disclosed in U.S. patent application Ser. No. 13/091,085 filed Apr. 20, 2011 and entitled "Flooring, Deck and Patio Surface System and Method of Use."

In the first method of attaching the structural panel 30 to the base mounting plate 4, a retaining clip connector 32 (FIG. 77), a threaded post 25 (FIGS. 73 to 76) and a panel puck 23 (FIGS. 69 to 72) are used. This is for a high wind condition where additional holding strength is necessary. Here, the structural panel 30 receives panel puck 23 such that their tapered side walls matingly conform. The downward motion of installing the panel puck 23 in the tapered walls of the structural panel 30 increases the holding friction. The panel puck 23 has an offset panel puck orifice 144. The retaining clip 32 has four edge flanges 140 that physically engage the detents on the structural panel cells. The retaining clip 32 (FIG. 77) has a bolt orifice 138 that also is offset from the center of the retaining clip 32 so as to align with the offset panel puck orifice 144. A threaded post 25 has it's bottom flange 142 locked beneath the base mounting plate 4 and the threaded post 25 extends through the panel puck orifice 144. A bolt is passed through the bolt orifice 138 in the retaining clip 32 and mechanically engage with the threaded post. This draws the structural panel 30 and the base mounting plate into tight connection. (The base mounting plate 4 is suitable connected directly or indirectly to the decking.)

In the second method of attaching the structural panel 30 to the base mounting plate 4, a panel puck 23 and a post 21 (FIGS. 65 to 68) are used. This offers less strength as it relies on frictional engagement only between the panel puck 23 and the walls of the structural panel 30. Here, without the high wind loads, there is no need for the retaining clip 32 or a bolt. (FIGS. 82 and 83)

The structural panel may be bolted through its retaining clip to a threaded post affixed to a base mounting plate. The retaining clip connector with the installed bolt will rest in its final position no higher than flush with the top of the structural panel such that no machining is required to place a finished stone, tile, concrete surface directly over the structural panel. Prior art panels utilize connectors that span more than one of their open cells leaving a protuberance above the plane of the panel proper.

It is to be noted that the structural panel 30 need not be used solely with a base mounting plate 4. When the open celled structural floor panel 30 is to be secured to the underlying surface or to framing members without the use of the base mounting plate 4, a screw is passed through the retaining clip connector 32 that has its edge flanges 140 resides residing in the detents 200 on the structural panel 30 and mechanically engaged into the underlying surface or framing members.

Base Mounting Plate with Pavers and Bricks

The base mounting plate 4 is used to align and support up to four paver plates 14 for the installation of a flooring surface of paver stones over an existing deck or deck framing. There are two ways that concrete pavers and bricks may be directly affixed to the base mounting plate 4.

First, a paver plate 14 is located and mounted on top of the base mounting plate 4 by insertion of the paver plate's hexagon pins 136 into the third set of orifices 134 in the base mounting plate 4. (FIG. 84) The corners of the finished flooring may be located with the edges of the paver plate 14.

In the second way, at least two brick posts 33 are located and mounted on top of the base mounting plate 4 by insertion into slots 124 on the base mounting plate 4. (FIG. 85) The corners of the finished flooring may be located with the sides of the brick posts 33.

Base Mounting Plate Configurations for Connection to Structural Lumber

The base mounting plate 4 is also used to connect to structural lumber joists below (as in a deck framing) to allow the addition of structural lumber (as for deck framing) above without the need for the deck framing to penetrate any roofing/deck waterproofing membrane. (FIGS. 86 to 88) The framing braces 12 (FIGS. 61 to 64) are planar plates with having two tapered posts 82 extending from either end that can be inserted for frictional engagement into the grouped orifices 126 of the base mounting plate 4. A plethora of angles may be accomplished on the base mounting plate 4 with the framing braces 12. Multiple framing braces 12 may be locked together to form a single perpendicular brace. (FIG. 87)

The Structural Panel

The structural panel is suitably provided in sheets having dimensions of 4 feet by 4 feet, with a 1.5 inch square open cell size, approximately 1 inch thick. The individual grid openings (cell 161) may be uniform or may narrow from the top of the panel to the bottom, such that they are wider at the top face than at the bottom.

A suitable panel that is employed with the system and method may be a fiber reinforced general purpose polyester molded resin panel, although other materials may be used. The panel size is preferably 4 foot by 4 foot in the preferred embodiment, based on construction standards and practices, but may be otherwise re-sized to the desired dimensions, within a 1/16th inch tolerance, so as to provide a system that functions with 16 inch and 24 inch framing dimensions typically used in deck applications. Note, however the 48"×48" square dimension meets the standard USA building dimension layout. The panel can be provided in other sizes than the illustrated example, chosen to have sufficient support while spanning the supporting elements supporting the panel. Preferably the panel is a pre-configured dimensional size suitable for compliance with customary building practices.

A surfacing material which may comprise a cut stone having an aesthetically pleasing appearance, color and/or pattern, is suitably bonded to the structural panel, using a bonding material such as a mastic/adhesive, for example. The surfacing material may also comprise manufactured stone-like material, tile, dry laid brick, concrete or stone pavers.

The Retaining Clip

Figure 77:
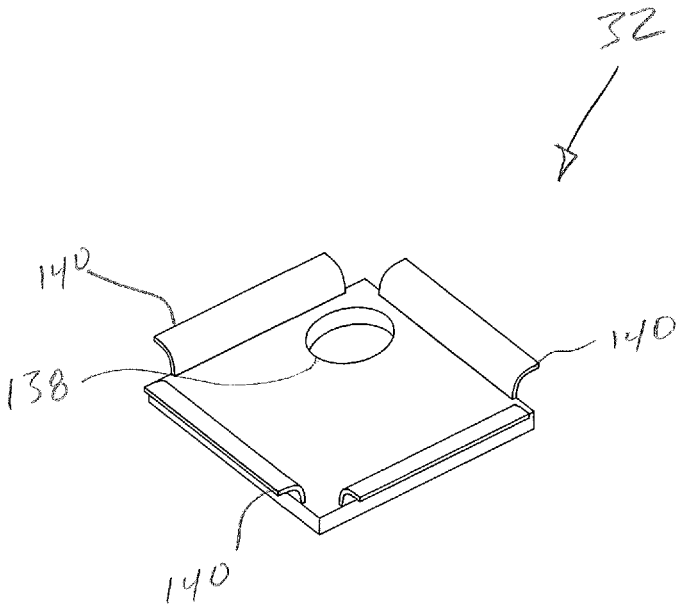
FIG. 77 is a top perspective view of the retaining clip 32.

The retaining clip 32 in a preferred embodiment is made of a stainless steel material, stamped into the shape shown in FIG. 77. The retaining clip 32 has four edge flanges 140 that physically engage linear detents on the structural panel's cells. The retaining clip 32 has a bolt orifice 138 that also is offset from the center of the retaining clip 32 so as to align with the offset panel puck orifice 144. The retaining clip 32 and bolt when utilized and bolted into the threaded locating posts 25, reside below the upper surface of the structural panel 30. In each of the four internal edges of each cell there is a small linear detent formed thereon (not visible in diagram) to receive the four edges of the retaining clip 32. In this way the clip 32 does not extend above the plane of the structural panel.

The Wedge Plate

The wedge plate 18 (FIGS. 45-48) has a taper across its body and a set of locating posts 130 that allow it to reside atop of the base mounting plate 4. It has through orifices and slots that conform with those on the base mounting plate 4 so that it may be used between the base mounting plate 4 and the structural panel 30 or the paver plates 14 or the brick posts 33.

The Stanchion Assembly

As can be seen in FIGS. 91 and 92 the stanchion assembly 7 is comprised of a stanchion 8, sandwiched between a stanchion top 8 and a stanchion bottom 10.

The top face of the stanchion top 6 (FIGS. 15-19) has a flange ring 70 that has a series of EFT 132 and twist lock gaps 74 that allow for the interlocking engagement of matingly conformed IFT 120 on the bottom faces of other components of the precision height adjustable flooring substrate support system. Here the "plunge and twist" style of interlocking frictional engagement between components has been utilized. This stanchion top 6 also has a central raised ring 75 extending there from that is sized to fit within the central stabilization groove formed thereon the bottom face of other components.

The top face of the stanchion bottom (FIGS. 10-14) has an upper circular sleeve 78 extending normally there from that accepts internally the bottom of stanchion post 8 for a frictional engagement. On the exterior surface of the upper circular sleeve 78 resides a series of four framing brace loops 82 that are 90 degrees apart to retain pivotable framing braces 16. It also has a series of screw orifices 66 about the perimeter.

The bottom face of the stanchion bottom plate (has a groove ring that has a series of IFT 120 and twist lock spaces 64 that allow for the interlocking engagement of matingly conformed EFT 132 on the top faces of other members of the precision height adjustable flooring substrate support system. However, on this component there is no central stabilization groove to accept the central ring flanges on other components.

The bottom face of the stanchion top 6 (FIGS. 15-19) has a lower circular sleeve 84 extending normally there from that accepts internally the top of the stanchion post 8 for a frictional engagement. On the exterior surface of the lower circular sleeve 84 resides a series of four framing brace loops 82 that are 90 degrees apart to retain pivotable framing braces 16. These are used in the same fashion as those on the stanchion top 6.

The Wide Base Assembly

FIGS. (35-44) show the two parts of the wide base assembly 20. This assembly 20 is made of a wide base 24 into which is internally screwed a micro adjust plate 22. The wide base 24 is a circular plate with a ribbed external flange 102 extending normally therefrom its bottom edge. This flange has screw orifice posts 104 formed there through. The top face has an internally threaded raised ring 106 extending normally there from and a central raised ring 75 with a central orifice extending there from the wide base 24, that is sized to fit within the central ring 106 formed thereon the bottom face of the micro adjust plate 22. It has the broadest footprint of any of the components.

The Micro Adjust Plate

The micro adjust plate 22 has an externally threaded external raised ring 110 that threadingly engages the internally threaded raised ring 106 of the wide base 24. Screwing together these two components allows for the precise height adjustment of the wide base assembly 20. As they are screwed together the center is stabilized by the frictional engagement between their respective central rings. Inside the externally threaded raised ring 106 is another concentric flange ring 70 that has a series of EFT 132 and twist lock gaps 74 that allow for the interlocking engagement of matingly conformed IFT 120 on the bottom faces of other components of the precision height adjustable flooring substrate support system.

The Support Guides

Figure 81:
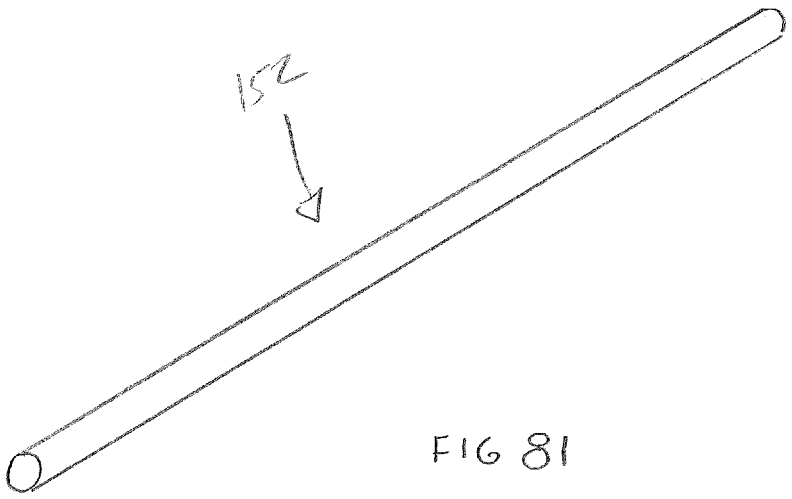
FIG. 81 is a perspective view of the support rod.
Figure 78:
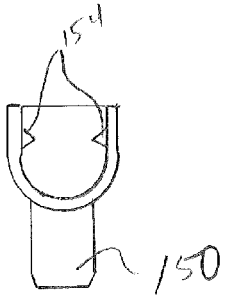
FIG. 78-80 are end, side and top views of the support guide.
Figure 79:
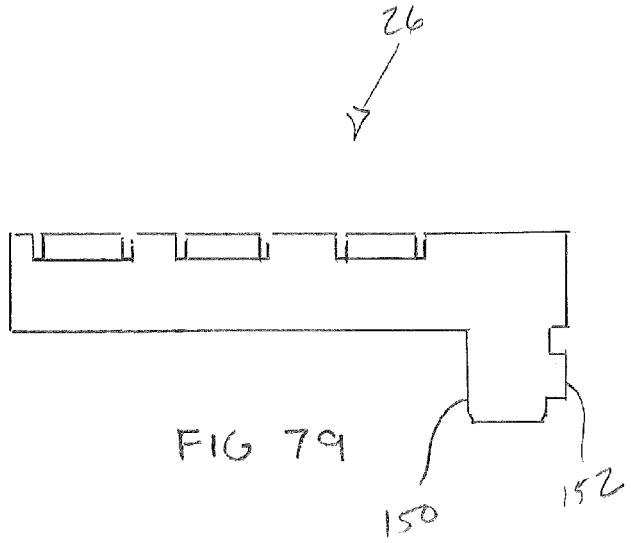
Figure 80:
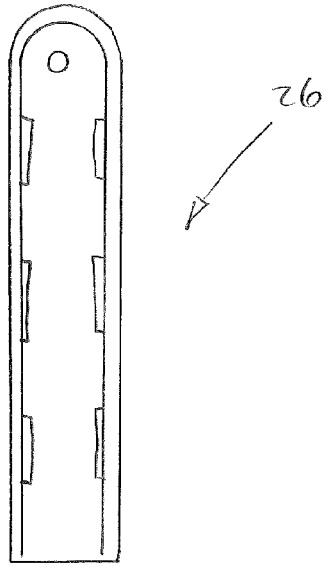

The pivotable support guides 26 (FIGS. 78-80) are C shaped tubes with a pivot post 150 extending at 90 degrees from one end. There is a locking lug 152 on the pivot post 150 The pivot post 150 is inserted into the framing brace loops 82 on the assembled stanchion assembly 7. Into the C of two different support guides 26 is glued a solid rod 152 (generally of a lightweight material such as nylon or a polymer) (FIG. 81). Teeth 154 help grip the rod 152 and hold it in place while the glue is setting up. The support guides 26 may be oriented in a horizontal or X pattern between adjacent stanchion assemblies depending upon the type of lateral support needed.

The Framing Braces

FIGS. 61-64 show the framing braces 12 which are rigid, rectangular, planar plates with a trapezoidal cross section and having two posts 82 extending normally from either end and through screw orifices 66 with tapered heads. The long edge sides 84 are angled at 45 degrees with one side having two tabs 86 and one side having two matingly engageable slots 88 for these tabs. In this way the framing braces 12 may be locked together to form a single perpendicular brace. (FIG. 87) These matingly engage into the base support plate 4.

The Stacker Plate

The stacker plates 16 (FIGS. 20-24) are circular plates approximately ½ inch thick each and are used to raise up any of the components so that either of the mounting plates can be raised to the desired height. The top face of the stacker plate has a flange ring 70 that has a series of EFT 132 and twist lock gaps 74 that allow for the interlocking engagement of matingly conformed IFT 120 on the bottom faces of other components of the precision height adjustable flooring substrate support system. In this way the "plunge and twist" style of interlocking frictional engagement between components can be utilized. This stacker plate top face also has a central raised ring 75 extending there from that is sized to fit within the central stabilization groove 64 formed thereon the bottom face of other components. There are screw orifices 66 formed there through and anchor plate protrusion rings 162 to secure the stacker plate 16 to the anchor plate 2.

The bottom face of the stacker plate 16 has a lock ring 92 that has a series of IFT 120 and twist lock spaces 64 that allow for the interlocking engagement of matingly conformed EFT 132 on the top faces of other members of the precision height adjustable flooring substrate support system. This component also has a central stabilization groove 65 to accept the central ring flanges on other components.

The Wedge Plate

Looking at FIGS. 45-48 the wedge plate 18 can best be seen. The wedge plate 18 has a ½° slope across the body and a series of orifices and slots formed there through as discussed herein. This allows any number of these wedge plates to be coupled together to overcome any angle on the deck base and ensure that the mounting plates are horizontal when installed. Its bottom face is generally unadorned and flat for attachment by mastic/adhesive for high wind conditions.

The various components are connected through the interlocking "plunge and twist" style of frictional engagement between the IFT 120 and the EFT 132 as described above with the central regions of the components supported by the various central rings.

There is a plethora of possible combinations used to overcome field situations of height and slope. The complete interconnectivity of the system components can be best seen with reference to TABLE A. The following TABLE B illustrates the structural differences between the various components of the height adjustable flooring substrate support system.

TABLE B

FLOORING SUBSTRATE SUPPORT SYSTEM COMPONENT STRUCTURAL FEATURES

| # | Name | TOP FACE FEATURES | BOTTOM FACE FEATURES | OTHER FEATURES |
|---|---|---|---|---|
| 2 | Anchor plate | Four equidistant spaced conical protrusions; | | screw orifices and drainage slots there through |
| 4 | Base Mounting | Slots for paver plate pins; orifices for | Outer ring with internally facing | Through screw orifices with |

TABLE B-continued

FLOORING SUBSTRATE SUPPORT SYSTEM COMPONENT STRUCTURAL FEATURES

| # | Name | TOP FACE FEATURES | BOTTOM FACE FEATURES | OTHER FEATURES |
|---|---|---|---|---|
| | Plate (for Pavers and Frames) | connection to framing braces; slots to receive paver plate pins, orifices to receive posts and threaded posts, tapered orifices for screws or wedge plate posts, slots for transit readout card, central depression for bubble level | teeth; depressed regions to house base of threaded post | tapered heads |
| 7 | Stanchion Assembly (made of top, stanchion and bottom) | | | |
| 6 | Stanchion Top Plate | Raised perimeter flange on bottom side with externally facing teeth; raised central ring for center stabilization within flush central groove | Raised ring sized to internally accept stanchion; Framing brace loops on external side of raised ring to adjustably retain framing braces | |
| 8 | Stanchion Post | Commercially available circular pipe sized to internally fit into raised rings | | |
| 10 | Stanchion Bottom Plate | Raised ring on top side sized to internally accept stanchion; Framing brace loops on external side of raised ring to adjustably retain framing braces | Perimeter groove with internally facing teeth | Through screw orifices and rings to receive the conical protrusions |
| 12 | Framing Braces | Rectangular, planar plate with trapezoidal cross section having two posts at either end and through screw orifices with tapered heads on the planar faces thereof; long edge sides angled at 45 degrees with one side having two tabs and one side having two matingly engageable slots | | |
| 11 | Leveler Plate Assembly | Allows various rotational configurations to alter the overall top and bottom slopes of the leveler plate assembly | | |
| 13 | Upper Leveler plate | | Lockable means in various rotations to Bottom Leveler Plate | Tapered body |
| 15 | Bottom Leveler Plate | Lockable means in various rotations to Upper Leveler Plate | | Tapered body |
| 14 | Paver Plate | 90 degree pie shaped wedge having sides on the two non circular perimeter edges; | Three locating paver plate pins | |
| 16 | Stacker Plates | Raised perimeter flange with externally facing teeth; raised central ring for center stabilization | Perimeter groove with internally facing teeth; Circular central groove | Through screw orifices |
| 18 | Wedge Plate | Tapers in thickness ½ degree across plate, raised location ribs | Has orifices and slots identical to those on base mounting plate | Rotatable in 90 degree increments |
| 20 | Wide Base Assembly (made of micro adjust plate 22 and wide base plate 24) | | | |
| 22 | Micro Adjust Plate | Central ring flange with through orifice; Raised internal circular flange adjacent outer | | Externally threaded about outer perimeter raised flange |

TABLE B-continued

| FLOORING SUBSTRATE SUPPORT SYSTEM COMPONENT STRUCTURAL FEATURES | | | | |
|---|---|---|---|---|
| # | Name | TOP FACE FEATURES | BOTTOM FACE FEATURES | OTHER FEATURES |
| | | perimeter externally threaded raised flange with externally facing twist interlock engagement teeth; | | |
| 24 | Wide Base Plate | Raised central ring for center stabilization within central ring flange, peripheral raised flange | | Internally threaded about raised flange; |
| 26 | Support Guide | C shaped linear member with round connector peg extending normally from one end | | |
| 28 | Support Rod | A circular rod sized to be retained within the C shaped linear member | | |
| 30 | Structural Panel | Rectangular grid of identical rectangular open cells, internal edges of each open cell have depressions for clip retention | Rectangular grid of identical rectangular open cells | |
| 32 | Retaining Clip | Square steel plate with offset bolt orifice and all four peripheral edges bent normally into sides away from the plane of the clip with each side's outer edge bent away from clip body | Offset bolt orifice | |
| 34 | Bolt | Standard bolt sized to fit retaining clip bolt orifice | | |
| 21 | Post | Cylindrical with rotational locking tabs | | Configured for insertion of hex key |
| 23 | Panel Puck | Offset orifice through it | Offset orifice through it | Hard rubber like polymer; tapered side walls |
| 25 | Threaded Post | Cylindrical with rotational locking tabs | Crescent shaped Base plate | Internally threaded to accept bolt from retaining clip |
| 33 | Brick Post | Planar with differing thicknesses | | |

System Advantages

In situations where the underlying surface is sloped, uneven, has protuberances or penetrations it is desirable to cheaply and securely raise the sub flooring system to a height that allows it to be horizontally planar or float just above a waterproofing deck surface. While cutting stanchions to accurately repeatable height dimensions will allow for a truly planar surface on another truly planar surface, such a working environment is rare. The predominant working surfaces are not completely level and micro adjustments in height must be made in the field to attain this. Attempting to adjust the height of the cut stanchions is far too inaccurate. The present system of interlocking members allows for a quick, simple and precise method for adjusting the height of the system at all supported points so as to allow for a truly planar array of structural panels.

The components of the system described herein provide a strong yet light-weight precise height adjustable underlayment assembly for a durable and secure exterior flooring surface for elevated decks and rooftop terraces, supplying strength, durability and creative flexibility.

In a particular embodiment, the outdoor floor system described herein weighs only 8-10 lbs. per square foot combined weight of the outdoor floor system underlayment and an average weight of a ¼"-½" gauged stone or tile, which falls within the "10-15 lbs./sq' of dead load" calculations for residential deck construction. Under these conditions the system can be placed over conventionally framed deck structures with joist spacing 16"-24" O.C. A roof top terrace will also only need to be designed for standard load conditions. Paver deck applications will be 10-20 lbs./sq' dead load and will require additional structural reinforcement and consultation with a licensed structural engineer.

The system can cover an existing cracked patio if the sub-grade is stable. The finished patio can be installed as a level surface with positive drainage, and no cracks will migrate through the new finished stone surface. It can also be placed over any solid bearing surface.

The high strength panel members have dimensional stability and minimal deflection under load conditions and require no additional surfacing material to achieve strength. This solid underlayment adds reinforcing strength to a stone/tile surface and bearing strength to a dry-laid paver surface.

The system further provides lateral strength or side-to-side stability, achieved in part by using adhesive to bond panel edges edge-to-edge, and by the use of screws or a mastic material applied to the component in contact with the deck/deck framing, and or through the use of the support rod 26 and support rod 28 arranged in a cross or horizontal pattern with adjacent component assemblies.

Accordingly, a system and method are provided whereby a deck surface of quarried stone is feasible. The use of the fiber reinforced polymer structural panels, the connectors and the adhering of the stone tiles results in a lightweight high strength system weighing only 8 to 10 pounds per square foot in the preferred embodiment. The bonding of the surface material to the structural panel provides further strength to the overall system. As noted above, other surface materials may be employed, including but not limited to tile, brick, concrete and stone pavers.

Under an ASTM #E72-98 test, an exemplary system withstood 6282 lbs. of force with no failure, a maximum 1.47" deflection and a maximum 0.35" set deflection.

Although the illustrated embodiment details an outdoor flooring system for use over a wood frame deck surface other uses are also possible. For example, the system and method can be employed as ground level patios, either as new construction or to cover a cracked or otherwise undesirable patio, providing positive drainage. Application to steps is also another use.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

I claim:

1. A precision height and slope adjustable flooring substrate support system comprising:

a generally planar, base mounting plate having a top face and a bottom face with at least one first orifice formed therethrough;

a post sized for mating engagement with said first orifice so as to extend normally therefrom said top face;

a planar polymer structural panel having an array of open cells formed there through;

a panel puck having tapered edges thereon and an offset second orifice formed therethrough, said panel puck dimensioned for frictional engagement within said open cells and wherein said offset second orifice is sized for frictional engagement with said post;

wherein said base mounting plate may be affixed to a deck [directly or indirectly], with said post engaged therein and extending normally therefrom so as to frictionally engage said panel puck that resides within said open cell of said structural panel, thereby securing said frictional panel to said deck.

2. The precision height and slope adjustable flooring substrate support system of claim 1 further comprising a wide base assembly designed for locking engagement with a bottom of said base mounting plate, said wide base assembly is height adjustable and made of a micro adjust plate having an external thread formed thereon that threadingly engages an internal thread formed therein a wide base plate.

3. The precision height and slope adjustable flooring substrate support system of claim 2 further comprising an adjustable height stanchion assembly interposed between said base mounting plate and said wide base assembly, said stanchion assembly comprising a stanchion made of a cut length of nominally sized pipe having a stanchion top plate affixed to an upper end of said stanchion and a stanchion bottom plate affixed to a lower end of said stanchion, wherein a top face of said stanchion top plate matingly engages said bottom face of said base mounting plate, and wherein a bottom face of said stanchion bottom plate engages a top face of said wide base assembly.

4. The precision height and slope adjustable flooring substrate support system of claim 1 wherein said open cells of said structural panel each have tapered sidewalls sloped to frictionally engage said tapered edges on said panel puck.

5. The precision height and slope adjustable flooring substrate support system of claim 1 wherein said post passes through said second orifice in said puck to frictionally engage said puck.

6. A precision height and slope adjustable flooring substrate support system comprising:

a generally planar, base mounting plate having a top face and a bottom face with at least one first orifice formed therethrough;

a threaded post sized for mating engagement with said first orifice so as to extend normally therefrom said top face;

a planar polymer structural panel having an array of open cells formed there through;

a retaining clip with a bolt receiving third orifice formed therethrough, said clip sized and adapted for retention within said open cell; and a bolt;

wherein said threaded post has a threaded recess formed therein adapted for threading engagement with said bolt, and said retaining clip may be retained within said same open cell wherein said bolt may pass through said clip and threadingly engage said threaded recess.

7. The precision height and slope adjustable flooring substrate support system of claim 6 wherein said third orifice in said retaining clip is offset from a center of said retaining clip so as to align vertically with said second orifice in said panel puck post when said retaining clip and said panel puck are used in the same open cell.

8. The precision height and slope adjustable flooring substrate support system of claim 7 wherein said post passes through said second orifice in said panel puck and said bolt passes through said third orifice in said retaining clip and threadingly engages said threaded post.

* * * * *